United States Patent [19]

Duhayon et al.

[11] 4,277,363

[45] Jul. 7, 1981

[54] METHOD FOR PROCESSING A MIXTURE OF AIR AND RARE GASES, ESPECIALLY XENON AND KRYPTON

[75] Inventors: Jacques Duhayon, Gif-sur-Yvette; Jean-Pierre Goumondy, Vitry; Alain Leudet, Massy; Jean-Claude Rousseau, Mainvilliers, all of France

[73] Assignee: Commissariat a l'Energie Atomique, Paris, France

[21] Appl. No.: 66,103

[22] Filed: Aug. 13, 1979

[30] Foreign Application Priority Data

Aug. 11, 1978 [FR] France ..... 78 23735

[51] Int. Cl.[3] ..... G21F 9/02

[52] U.S. Cl. ..... 252/301.1 W; 55/66; 62/22; 176/37

[58] Field of Search ..... 252/301.1 W; 55/66; 176/37; 62/22

[56] References Cited

U.S. PATENT DOCUMENTS

| | | | |
|---|---|---|---|
| 3,155,469 | 11/1964 | Lehmer et al. | 55/66 |
| 3,404,067 | 10/1968 | Rendos | 55/66 |
| 3,596,471 | 8/1971 | Streich | 62/22 |
| 3,850,593 | 11/1974 | Beaujean et al. | 55/66 |
| 3,922,150 | 11/1975 | Yusa et al. | 55/66 |
| 4,055,625 | 10/1977 | Faugeras et al. | 176/37 |
| 4,078,907 | 3/1978 | Schlea | 176/37 |
| 4,115,081 | 9/1978 | Ohno et al. | 55/66 |

*Primary Examiner*—Deborah L. Kyle

*Attorney, Agent, or Firm*—Sughrue, Rothwell, Mion, Zinn and Macpeak

[57] ABSTRACT

The method for processing a mixture of air and rare gases consisting especially of xenon and krypton which are at least partially radioactive and especially for processing gaseous effluents arising from the reprocessing of irradiated fuels comprises a step involving concentration of the rare gases in solution in liquid argon by cryogenic distillation of the light gases and mainly nitrogen from the liquefied mixture.

8 Claims, 3 Drawing Figures

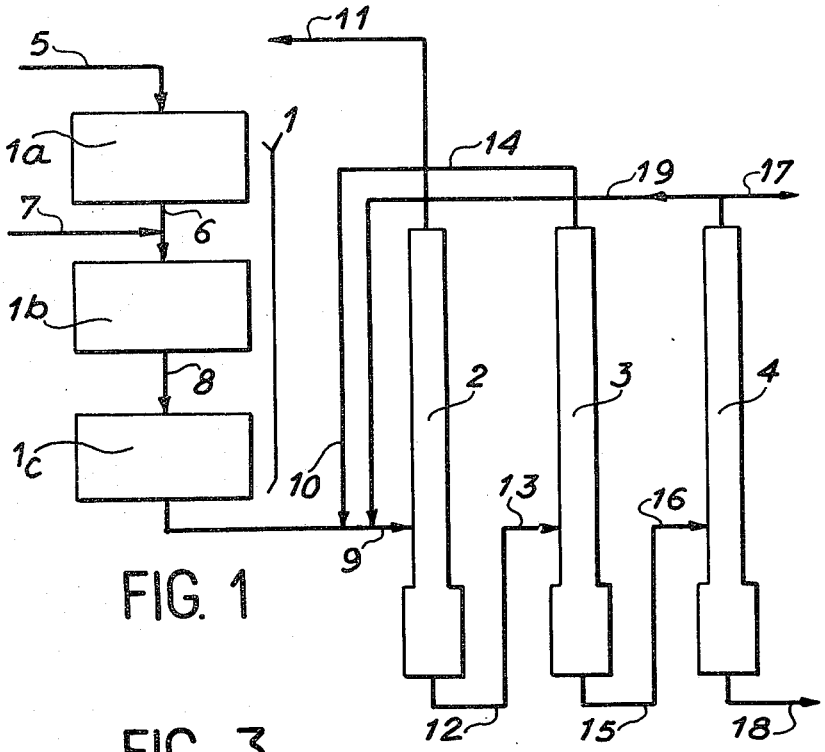
FIG. 1
FIG. 3
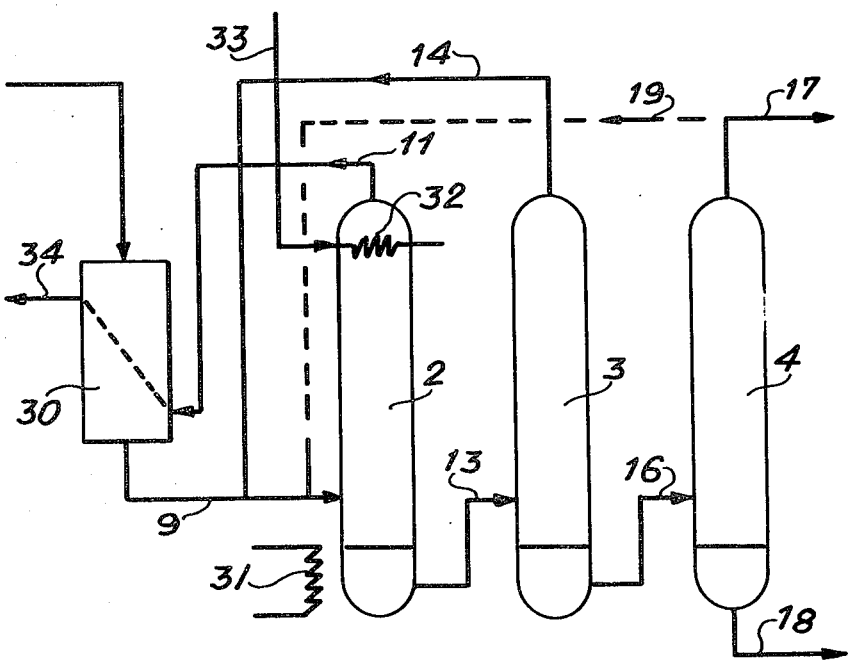

METHOD FOR PROCESSING A MIXTURE OF AIR AND RARE GASES, ESPECIALLY XENON AND KRYPTON

This invention relates to a method for processing a mixture of air and rare gases, especially xenon and krypton, and more especially for processing gaseous effluents arising from the reprocessing of irradiated nuclear fuels, a further object of this processing operation being to recover the xenon contained in these mixtures.

The gaseous effluents from irradiated fuel reprocessing plants essentially consist of air having a concentration of oxygen which can be lower than the natural concentration, and rare gases such as xenon and krypton; such effluents usually contain water vapor, carbon dioxide gas, traces of hydrocarbons and also of nitrogen oxides, the presence of which is due to the dissolution of fuels in a nitric acid medium.

The known methods for processing said gaseous effluents essentially comprise a purification step for delivering a mixture of air and rare gases which is free from other impurities, then a step consisting of preconcentration of the rare gases in one of the two constituents of air, namely oxygen or nitrogen.

In the process which consists in preconcentrating the rare gases in nitrogen, said preconcentration step is carried out after catalytic reduction of the entire quantity of oxygen contained in the mixture with hydrogen and consists in concentration of the rare gases in a fraction of the nitrogen by cryogenic distillation. The mixture of krypton and xenon in the nitrogen is then subjected to a further cryogenic distillation in order to separate the krypton and nitrogen from the xenon. This method suffers from a disadvantage by reason of the low solubility of xenon in liquid nitrogen, thus giving rise to clogging of distillation columns as a result of crystallization of the xenon.

In the other method which consists in preconcentrating the rare gases in oxygen, this preconcentration is carried out by removing the entire quantity of nitrogen contained in the mixture as well as part of the oxygen by cryogenic distillation. The krypton and xenon mixture concentrated in the oxygen which is then obtained is first subjected to a step involving catalytic reduction of the oxygen with hydrogen, then to a cryogenic distillation step in order to separate the krypton from the xenon. Compared with the method of preconcentration in nitrogen, the advantage of this method lies in the fact that xenon has much greater solubility in liquid oxygen than in liquid nitrogen. By reason of the radioactivity of the medium, however, ozone is formed in the boiler of the distillation column; this presence of ozone gives rise to explosion hazards. These explosion hazards could quite conceivably be forestalled by continuous destruction "in situ" of the ozone which is formed; the design development of an ozone removal system of this type, however, gives rise to a certain number of problems and has never been carried into practical effect.

The present invention is precisely directed to a method of processing, especially of gaseous effluents arising from the reprocessing of irradiated fuels, which overcomes the disadvantages recalled in the foregoing. In fact, the method under consideration does not give rise to the formation of ozone and there is consequently no attendant danger of explosion. In regard to crystallization of xenon, such problems can readily be circumvented.

The method according to the invention essentially comprises a step involving concentration of rare gases in solution in liquid argon by cryogenic distillation of light gases and mainly nitrogen from the liquefied mixture.

Preferably, said method further comprises, after said concentration step, a step involving recovery of the xenon by cryogenic distillation of the other gas or gases from the concentrated and liquefied mixture.

In fact, the present Applicant has studied the behavior of xenon from the point of view of solubility in three cryogenic solvents, namely oxygen, nitrogen and argon. In the studies made by the Applicant, it has been sought to determine the maximum pressure at which a solid-liquid-vapor xenon-solvent equilibrium can exist. In order to prevent any danger of crystallization of the xenon, it was therefore important to carry out the preconcentration step at the notable pressure aforesaid. The researches conducted by the present Applicant have led to the discovery that, in the case of an oxygen-xenon system, said notable pressure has a maximum value of 17 bar absolute, that said notable pressure has a maximum value of 18.5 bar absolute in the case of an argon-xenon system, and that said notable pressure would be appreciably higher and of the order of 35 bar absolute, for example, in the case of a nitrogen-xenon system.

For the foregoing reason, the fact of carrying out a step involving preconcentration of xenon and of krypton in liquid argon in the method according to the invention has the advantage over the method of preconcentration of xenon and krypton in nitrogen of preventing crystallization of the xenon by carrying out cryogenic distillation at a distinctly lower pressure. A further advantage over the method of preconcentration of xenon and krypton in oxygen lies in the fact that ozone formation is avoided.

The invention is also directed to a method of processing of effluent gases arising from the reprocessing of irradiated nuclear fuels constituted by a mixture containing at least radioactive krypton and xenon in air. The method essentially and successively comprises a first step involving removal of any impurities such as hydrocarbons, nitrogen oxides, carbon dioxide gas, water vapor, a second step involving concentration of xenon and krypton in solution in liquid argon by distillation of the light gases and mainly nitrogen from the liquefied mixture, a third step involving removal of argon by cryogenic distillation of the separated mixture of argon, xenon and krypton which has previously been liquefied, and a fourth step involving separation of xenon and krypton by cryogenic distillation of the separated mixture of xenon and krypton which has previously been liquefied.

In the method under consideration, the argon required for the second concentration step can be introduced into the gas mixture to be processed either before the first step involving removal of various impurities or before the second concentration step.

According to an advantageous feature of the method of the invention, part of the krypton which has been separated from the xenon and obtained during the fourth step is introduced into the mixture obtained at the end of the first step before proceeding to the second step of concentration of the xenon and krypton in solution in liquid argon. This re-introduction of a certain quantity of the krypton obtained at the end of the process makes it possible to reduce the pressure at which the second step of concentration of xenon and krypton in liquid argon is carried out.

It is readily apparent that the invention also extends to suitable installations for the practical application of the method. Installations of this type comprise in particular catalytic reactors and cryogenic distillation columns with all their ancillary equipment units which are known per se, arranged and connected together by means of pipes for the circulation of different products, thus making it possible to perform the successive operations of the method defined in the foregoing.

The distinctive features of an installation of this type and of the method under consideration will become more clearly apparent from the following description which relates to one example of execution of the invention and is given without any implied limitation, reference being made to the accompanying drawings, wherein:

FIG. 1 is a schematic illustration of the general procedure involved in the method herein described and of the installation employed;

FIGS. 2 and 3 are schematic diagrams in which parts of the installation employed and the circulation of products between the different steps are shown in greater detail.

Figure 2:
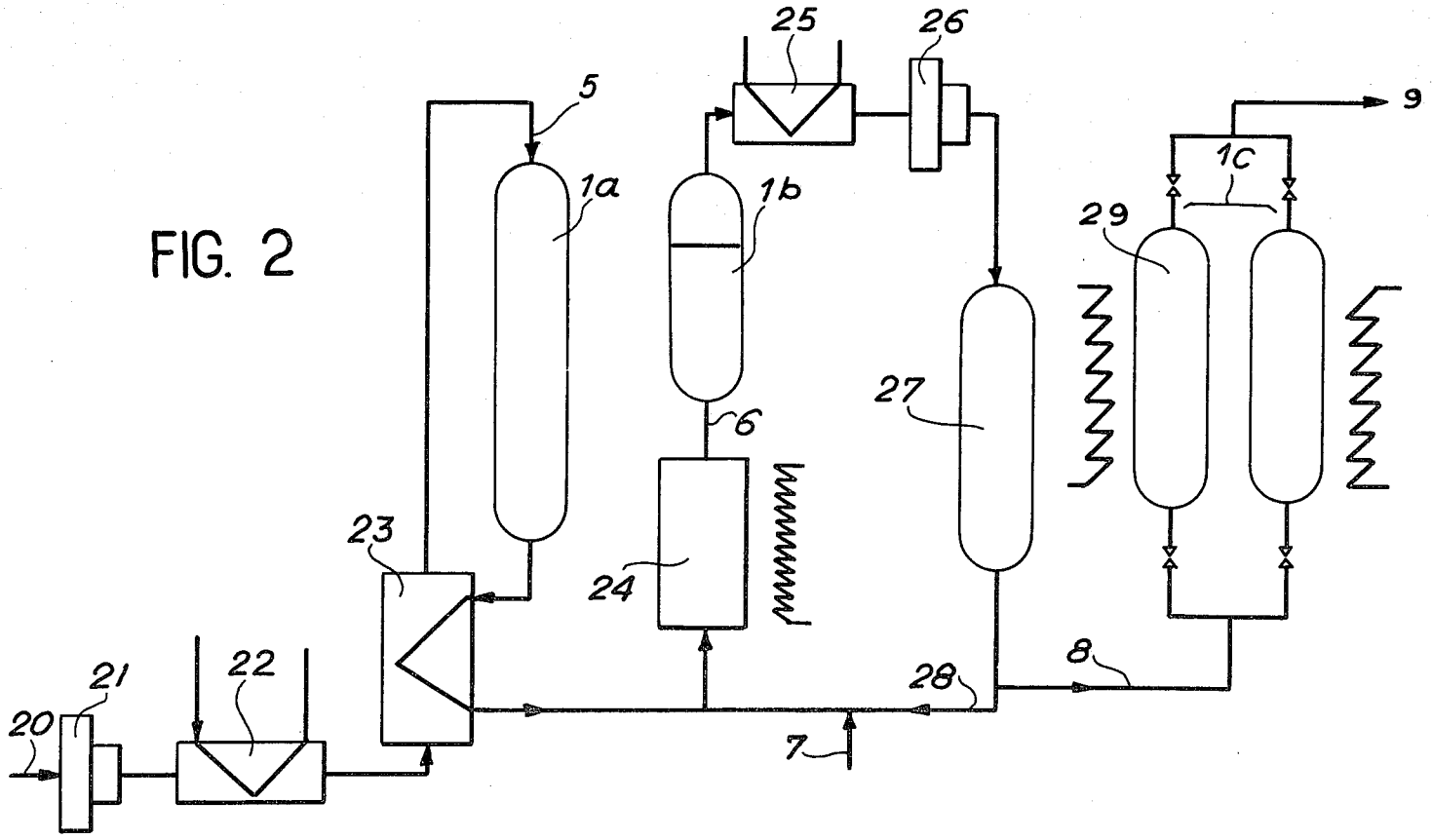

The different processing units for carrying out the successive steps of the method according to the invention are shown diagrammatically in FIG. 1 and in the following order:

at 1: the unit for the first processing step of removal of impurities from the gas mixture produced by the nuclear fuel reprocessing plant; this initial purification step makes it possible to obtain a mixture consisting of air which practically contains no constituents other than xenon and krypton and is carried out in three successive stages respectively within three units shown diagrammatically at 1*a*, 1*b* and 1*c*;

at 2: a column for the second step of concentration of xenon and krypton in liquid argon, thus making it possible to remove mainly the nitrogen from the mixture and to collect a concentrated mixture of xenon and krypton in argon;

at 3: a column for the third step of removal of argon by cryogenic distillation of the mixture of argon, xenon and krypton;

at 4: a column for the separation of xenon and krypton by cryogenic distillation in order to remove the krypton and to collect pure xenon.

In more precise terms, the first step of removal of any impurities contained in the initial gas mixture comprises a first stage of removal of hydrocarbons by catalytic oxidation (and also of catalytic dissociation of nitrogen oxide $N_2O$) which is performed within the unit shown at 1*a*; a second stage of removal of oxygen and nitrogen oxides by catalytic reduction which takes place within the unit shown at 1*b*; and a third stage of removal of carbon dioxide gas and of water vapor by passing through a molecular sieve and/or silica gel which takes place within the unit shown at 1*c*.

Thus the gas mixture to be processed is first introduced at 5 into the unit 1*a* and discharged from said unit after removal of the hydrocarbons. The mixture is then introduced at 6 into the unit 1*b* in which a catalytic reduction is carried out in the presence of palladium by the action of hydrogen supplied at 7. Said mixture passes out of said 1*b* after removal of the oxygen and nitrogen oxides and is introduced at 8 into the unit 1*c* in which it is freed from the carbon dioxide gas and water vapor by passing it through a molecular sieve. Thus the mixture introduced into the column 2 at 9 is a mixture of nitrogen, xenon and krypton which first receives an addition of argon at 10 prior to admission into the column 2. The cryogenic distillation which permits removal of the nitrogen at 11 is carried out within the column 2, thus making it possible to recover a mixture of argon, xenon and krypton at 12. This mixture of argon, xenon and krypton is then introduced at 13 into the column 3 in which removal of argon is performed at 14 by cryogenic distillation and recovery of a mixture of krypton and xenon at 15. Said mixture of krypton and xenon is then introduced at 16 into the column 4 in which the krypton is removed at 17 by cryogenic distillation and in which pure xenon is recovered at 18.

In a preferred embodiment of the invention, part of the krypton removed at 17 can be recycled at 19 and fed back to the inlet of column 2 in order to permit cryogenic distillation at a lower pressure.

In accordance with the invention, the pressure at which cryogenic distillation is carried out within column 2 has a maximum value of 18 bar; the pressure at which cryogenic distillation is carried out within column 4 is approximately 3 bar; and the pressure at which cryogenic distillation is carried out within column 3 is comprised between the pressure of column 4 and the pressure of column 2.

FIG. 2 shows in greater detail the different elements and circuits for interconnecting the units 1*a*, 1*b*, 1*c*, in which the first step of removal of impurities according to the method of the invention is carried out. The gas mixture to be processed and derived from the irradiated fuel reprocessing plant is first introduced at 20 into a compressor 21, then cooled by a circulation of water within a cooler 22. After passing through a heat exchanger 23, said gas mixture is introduced at 5 into the unit 1*a* which contains a platinum or rhodium catalyst: within said unit 1*a*, the hydrocarbons are removed from the gas mixture by catalytic oxidation and removal of the nitrous oxide $N_2O$ also takes place by catalytic dissociation of this latter. An external heating device serves to maintain a maximum temperature 700° C. within said unit 1*a*. At the outlet of the unit 1*a*, the gas mixture from which hydrocarbons have been removed passes into the heat exchanger 23 and then, after mixing with part of the gas mixture which comes from the water separator 27, passes into an electric reheating system 24 in which said mixture is brought to a temperature of 100° C. and is introduced into the unit 1*b* at 6. The oxygen and the nitrogen oxides are removed by catalytic reduction within said unit 1*b* which contains a palladium catalyst and may also contain a rhodium catalyst, and hydrogen is introduced at 7 in order to maintain a slight excess quantity of said gas at the outlet of said unit 1*b*. After passing out of the unit 1*b*, the gas mixture from which oxygen and nitrogen oxides have been removed is cooled in a water cooler 25 and then passes into a ventilator 26. At the outlet of the ventilator 26, pat of the gas mixture first passes thorugh a water separtor 27 to be recycled at 28 to the unit 1*b* and the other part is directed at 8 towards the unit 1*c*.

the mixture which is introduced into the unit 1*c* at 8 is freed from the water vapor and from traces of $CO_2$ by passing through a molecular sieve and/or a silica gel within one of the two absorbers 29 which are placed in parallel; these two absorbers 29 are subjected periodically and in alternate sequence to regeneration by heating and circulation of nitrogen.

There are again shown in FIG. 3 the columns 2, 3 and 4 which serve respectively to carry out the second, the third and fourth steps of the method according to the invention. The gas mixture containing nitrogen, argon, krypton and xenon derived from the unit 1 is first cooled within a heat exchanger 30, then introduced into the column 2 at 9.

The distillation column 2 operates at a maximum pressure of 18 bar. The lower portion of the column 2 is maintained at the necessary temperature by means of an electric heating device 31. At the head of the column 2, a reflux is carried out by a condenser 32 which is cooled by liquid nitrogen supplied at 33. A mixture containing mainly nitrogen and possibly a fraction of argon is withdrawn from the top of the column 2 at 11; this mixture can be recycled to the fuel element shearing or decladding sweep circuit or discharged to the atmosphere; the mixture is heated beforehand by passing through the heat exchanger 30 from which it is discharged at 34. A liquid mixture of argon concentrated in krypton and xenon is withdrawn from the bottom of the column 2 and introduced at 13 into the distillation column 3.

Within column 3 which operates at a pressure comprised between the pressure of column 4 and the pressure of column 2, the argon is separated by cryogenic distillation at 14 and the mixture of krypton and xenon is collected at the bottom of the column 3. If necessary, the argon which leaves the column 3 at 14 can be recycled to the inlet of column 2.

The mixture of krypton and xenon which leaves the bottom of the column 3 is fed into the column 4 and 16 in which separation of the krypton and the xenon is carried out by cryogenic distillation: the krypton is obtained at 17 at the head of column 4 and the xenon is obtained at 18 at the bottom of column 4.

If necessary, part of the krypton obtained at 17 is recycled at 19 to the inlet of column 2; this makes it possible to increase the relative proportion of krypton contained in the feed gas mixture and to carry out the initial cryogenic distillation within column 2 at a pressure which is appreciably lower than 18 bar. For example, in the case of a krypton to xenon ratio of 1 obtained with a reflux of krypton from 10, the operating pressure of column 2 can be reduced to a value of 10 bar.

The pure xenon obtained at 18 is a marketable product.

One example of circulation of products is given hereinafter by way of indication together with particulars on the concentrations of the mixtures and the different flow rates. For the sake of convenience, reference will be made to FIG. 1.

The gas mixture to be processed and to which has been added a predetermined quantity of argon has the following composition: 81% nitrogen, 11% oxygen, 8% argon, 150 ppm of krypton, and 1500 ppm of xenon, hydrocarbons, nitrogen oxides, water vapor and carbon dioxide gas. The mixture is introduced into the unit 1*a* at 5 at a flow rate of 21.8 $m^3$ per hour. At the outlet of the unit 1*a*, the mixture which has been freed from hydrocarbons is introduced into the unit 1*b* at 6 and hydrogen is introduced at 7 at a flow rate of 4.8 $m^3$ per hour. At the outlet of the unit 1*b*, the mixture from which oxygen and nitrogen oxides have been removed is introduced into the unit 1*c* at 8. At the outlet of said unit 1*c*, the gas mixture from which water vapor and $CO_2$ have been removed is introduced into column 2 at 9: at this moment, the mixture has the following composition: 88% nitrogen, 12% argon, 150 ppm of krypton and 1500 ppm of xenon; the mixture is then introduced into column 2. At the head of column 2, a mixture containing 91% nitrogen and 9% argon is recovered at 11. A mixture containing 94.5% argon, 0.5% krypton and 5% xenon is recovered at the base of column 2. This mixture is introduced into column 3 at 13. At the head of column 3, argon is recovered at 14 at a flow rate of 600 l/hr and a mixture containing 10% krypton and 90% xenon is recovered at the base of column 3. This mixture is introduced into column 4 at 16. Krypton is recovered at a flow rate of 1 l/hr at the head of column 4 at 17 and xenon is withdrawn at a flow rate of 30 l/hr from the bottom of column 4. The values given in the foregoing relate to the case in which recycling of part of the krypton obtained at 17 to the inlet of column 12 is not carried out.

If said recycling of part of the krypton is effected at the end of the process at 19, for example at a flow rate of 27 l/hr, the gas mixture fed to the inlet of column 2 at 9 then has the following composition: 88% nitrogen, 12% argon, 1500 ppm of krypton and 1500 ppm of xenon. This permits operation of the column 2 at a pressure of the order of 10 bar instead of 18 bar.

We claim:

1. A method for processing a mixture of air and rare gases, at least some portion of which is radioactive, as gaseous effluents arising from the reprocessing of irradiated fuels, wherein said method comprises concentrating the rare gases in solution in liquid argon, as a liquefied mixture, by cryogenic distillation of light gases, a major portion of which is nitrogen, from the liquefied mixture.

2. A method according to claim 1, wherein said method comprises a cryogenic distillation from the concentrated and liquefied mixture to recover xenon.

3. A method according to claim 1, wherein the concentration of the rare gases is carried out at a maximum pressure of 18 bar.

4. A method for processing effluent gases arising from the reprocessing of irradiated nuclear fuels and comprising a mixture of gases containing at least radioactive krypton and xenon in air, wherein said method successively comprises (1) removing any impurities from said mixture, (2) concentrating xenon and krypton in solution in liquid argon as a liquefied mixture by distiliation of light gases, a major portion of which is nitrogen, from the liquefied mixture, (3) liquefying the mixture of argon, xenon and krypton separated in step (2) and removing argon therefrom by cryogenic distillation thereof to obtain a mixture remaining of xenon and krypton, and (4) liquefying the mixture of xenon and krypton obtained in step (3) and separating the xenon from the krypton by cryogenic distillation thereof.

5. A method according to claim 4, wherein part of the krypton which has been separated from the xenon and obtained during step (4) is introduced into the mixture obtained at the end of step (1) before proceeding to the concentration of the xenon and krypton in solution in liquid argon in step (2).

6. A method according to claim 4, wherein step (1) comprising removing any impurities comprises an initial stage of removal of hydrocarbons by catalytic oxidation, a second stage of removal of oxygen and nitrogen oxides by catalytic reduction, and a third stage of removal of carbon dioxide gas and of water vapor by passage through a molecular sieve and/or silica gel.

7. A method according to claim 4, wherein the separation of xenon and krypton in step (4) is carried out at a pressure of approximately 3 bar.

8. A method according to claim 4, wherein the removing of argon from the mixture of argon, xenon and krypton in step (3) is carried out at a pressure between the pressure at which step (4) is conducted and the pressure at which step (2) is conducted.

* * * * *